United States Patent [19]

Mukoyama

[11] Patent Number: 4,600,135

[45] Date of Patent: Jul. 15, 1986

[54] NAIL DRIVING TOOL

[75] Inventor: Kenji Mukoyama, Anjo, Japan

[73] Assignee: Makita Electric Works, Ltd., Anjo, Japan

[21] Appl. No.: 686,754

[22] Filed: Dec. 27, 1984

[30] Foreign Application Priority Data

Dec. 29, 1983 [JP] Japan ..... 58-202249[U]

[51] Int. Cl.[4] ..... B25C 1/04; B25C 7/00

[52] U.S. Cl. ..... 227/120; 227/130

[58] Field of Search ..... 227/120, 130, 121, 109

[56] References Cited

U.S. PATENT DOCUMENTS 3,330,462 7/1967 Colechia et al. ..... 227/109 X 4,319,705 3/1982 Geist et al. ..... 227/120

*Primary Examiner*—Paul A. Bell

*Attorney, Agent, or Firm*—Dennison, Meserole, Pollack & Scheiner

[57] ABSTRACT

Disclosed herein is an improved nail driving tool comprising a housing including a reciprocable driver, a driver guide fixedly connected to and extending vertically from the lower end of the housing for slidably receiving the driver therein, a handle secured to and extending laterally outwardly from the central portion of the housing, and a magazine including a storing portion adapted to receive a nail package including a multiplicity of nails interconnected in series and a nail guiding portion adapted to guide the leading portion of the nail package to the driver guide, the magazine including a fixed wall portion secured at one end to the driver guide and extending generally below and parallel with the longitudinal extent of the handle and a closure wall portion pivotally movable about the driver guide with respect to the fixed wall portion between an operative closed position and an open position exposing the interior of the magazine.

7 Claims, 7 Drawing Figures

NAIL DRIVING TOOL

BACKGROUND OF THE INVENTION

This invention relates generally to nail driving tools, and more particularly to nail driving tools of the type driving nails arranged on a package in coiled configuration, one at a time into a workpiece. This invention is particularly concerned with an improved closure structure of the magazine in such tools.

SUMMARY OF THE INVENTION

Generally, this invention contemplates an improved nail driving tool comprising a housing including a reciprocable driver, a driver guide fixedly connected to and extending vertically from the lower end of the housing for slidably receiving the driver therein, a handle secured to and extending laterally outwardly from the central portion of the housing, and a magazine including a storing portion adapted to receive a nail package including a multiplicity of nails interconnected in series and a nail guiding portion adapted to guide the leading portion of the nail package to the driver guide, the magazine including a fixed wall portion secured at one end to the driver guide and extending generally below and parallel with the longitudinal extent of the handle and a closure wall portion pivotally movable about the driver guide with respect to the fixed wall portion between an operative closed position and an open position exposing the interior of the magazine.

It is, accordingly, the primary object of the present invention to provide an improved nail driving tool employing an improved magazine means which can be easily and rapidly opened in a direction away from the operator, to facilitate the insertion of another package of nails into the magazine and the guidance of the leading portion of the inserted package into the driver track.

The present invention will become more fully apparent from the claims and description as it proceeds in connection with the drawings.

DETAILED DESCRIPTION OF THE PREFERRED EMBODIMENT

Figure 1:
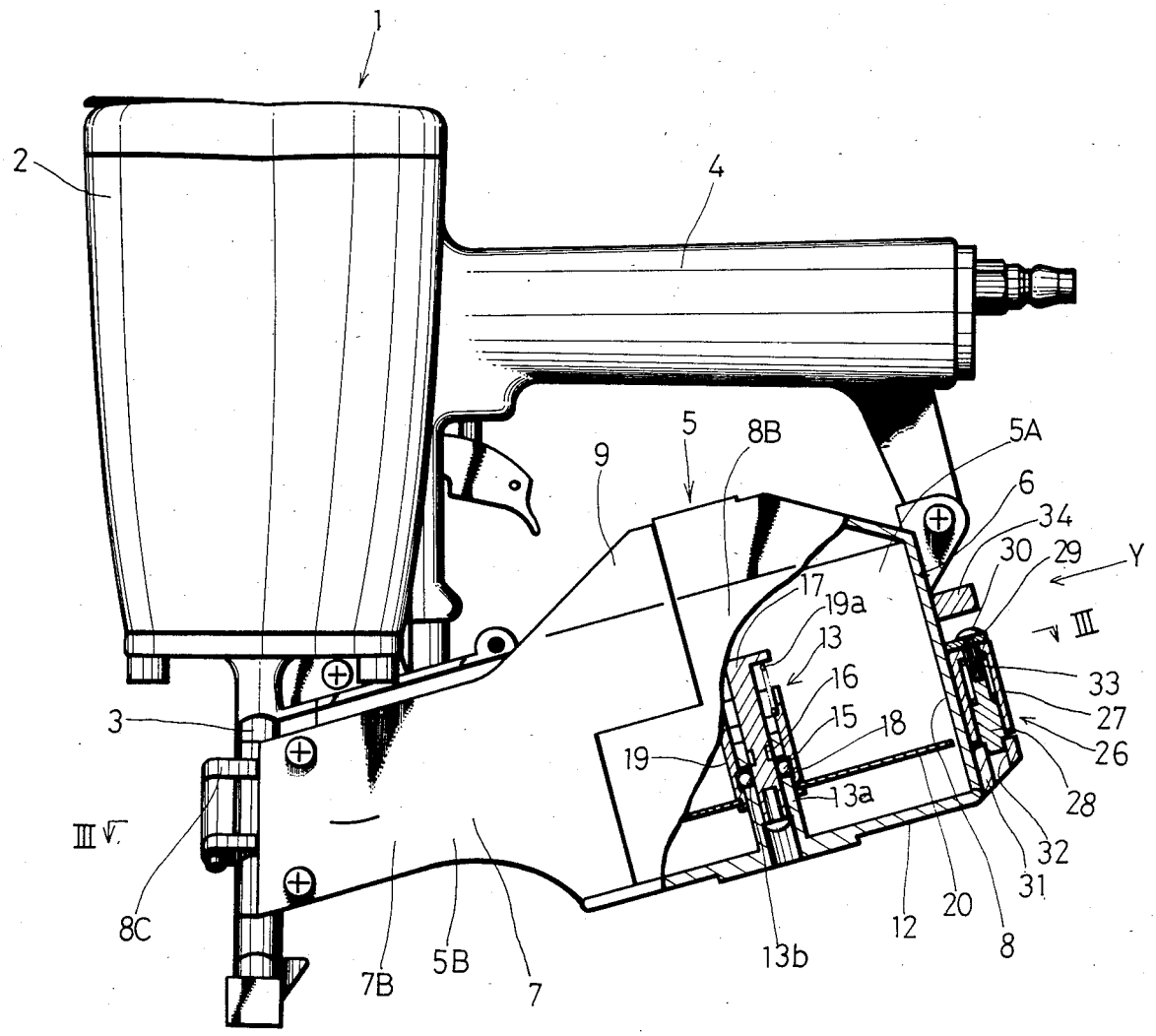
FIG. 1 is a side elevational view of a nail driving tool, partly in cross section, embodying the principles of the present invention.

Referring to the drawings and to FIG. 1 in particular, shown therein and generally designated by the reference numeral 1 is a nail driving tool embodying the principles of the present invention. As shown therein, the nail driving tool 1 includes a housing 2 having a driver guide 3 for guiding a nail driver (not shown) extending axially downwardly from one end thereof, a handle 4 secured to the outer periphery of the housing

2 and extending laterally outwardly therefrom. The rearward end of the handle 4 is formed with a downwardly depending, handle butt portion which supports the rearward end of a magazine 5 constructed in accordance with the present invention.

Figure 2:
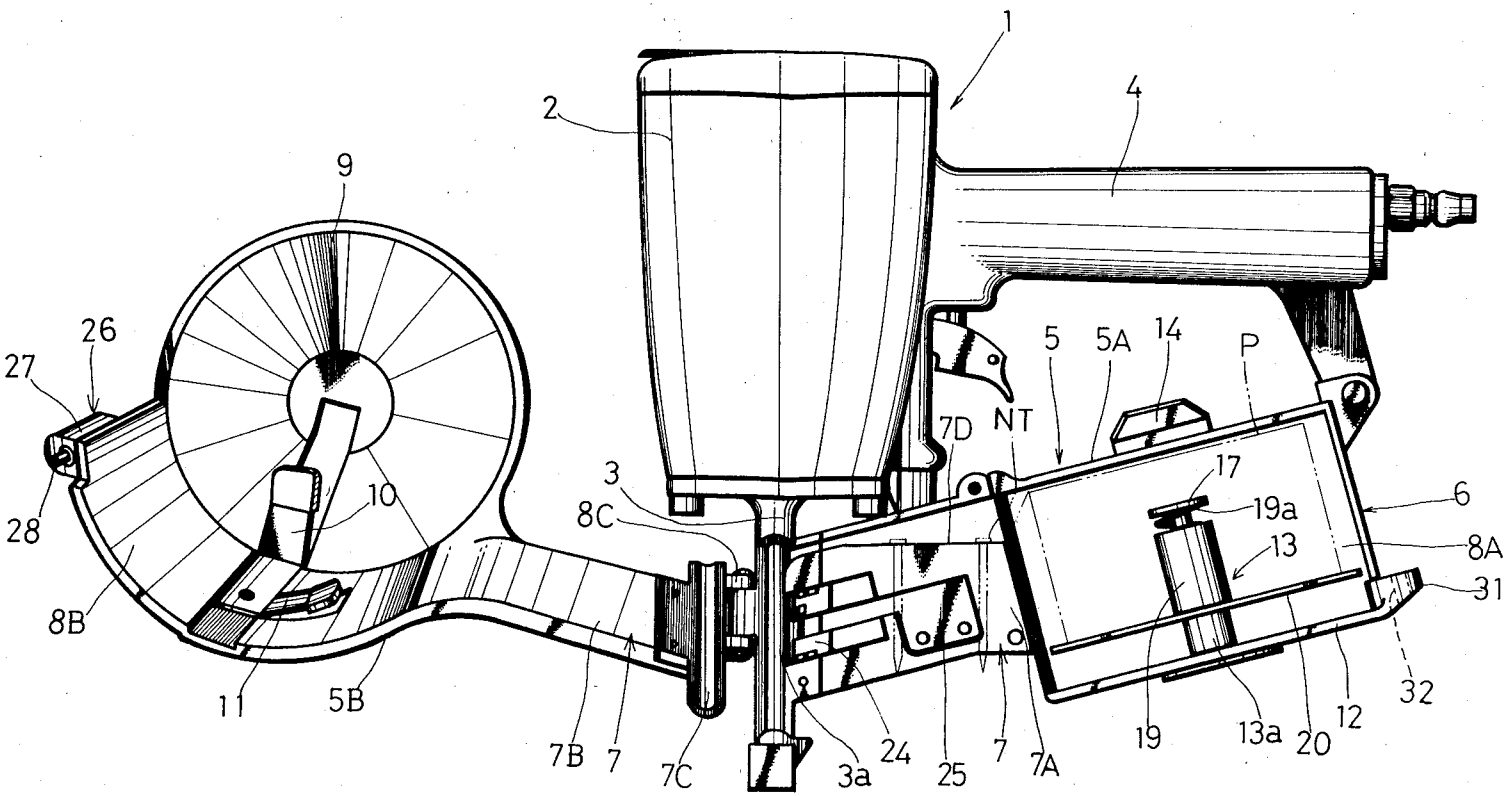
FIG. 2 is a fragmentary side elevational view of the magazine illustrating the same in its opened loading position.

The magazine 5 includes a storing section 6 for storing a nail package P and a nail guiding section 7 for directing the nail package P into a drive track 3*a* of the driver guide 3. The storing section 6 is substantially cylindrical in shape including a peripheral wall section 8. As may be seen from FIGS. 2 and 3, the nail guiding section 7 and the cylindrical wall section 8 are vertically divided into halves as generally indicated at 7A, 7B and 8A, 8B, respectively, and thus the magazine 5 includes a fixed wall section 5A (7A, 8A) which is secured to one side of the driver guide 3 and an opposite cover wall section 5B (7B, 8B) which is pivotable by an inclined hinge means 8C secured to the other side of the driver guide 3. The magazine 5 is preferably of steel, but the cover wall section 5B may be of a transparent molded plastic material in order to provide visibility of the interior components. The semicylindrical wall section 8B of the fixed section 5B has a substantially conical cover 9 formed integrally therewith for covering the storing section 6. Connected to the interior surface of the semicylindrical wall section 8B is a pair of elastic metal strips 10 and 11 for resiliently holding the nail package P on its top and side portions. The metal strip 10 extends axially upwardly along the interior surface of the semicylindrical wall section 8B and bent inwardly below the inner periphery of the cover 9. The other metal strip 11 is secured at one end to the semicylindrical wall section 8B together with the first metal strip 10, the other end extending along the periphery of the semicylindrical wall section 8B.

The nail guiding section 7 of the cover section 5B thus forms a nail guiding wall section 7B continuous from the semicylindrical wall section 8B, the end portion being served as one part 7C of the drive track 3*a*. As may be seen from FIGS. 1, 2, 3 and 5, the cover section 5B may be opened and closed with respect to the fixed section 5A through the hinge means 8C secured to the driver guide 3, so that the semicylindrical wall section 8A and the nail guiding wall section 7A of the fixed section 5A, and the drive track 3*a* of the driver guide 3 may be exposed. Thus, the cover wall section 5B is interconnected with the fixed wall section 5A by the inclined hinge means 8C for pivotal movement in a direction away from the fixed wall section 5A, that is, into an open position remote from the handle 4.

The nail guiding wall section 7A of the fixed section 5A is secured to the driver guide 3 as described above and is spaced a predetermined distance from the nail guiding wall section 7B of the cover section 5B. The nail guiding wall section 7A is provided with a longitudinally extending channel 7D to guide the heads NT of the nails in the package P. Secured to the lower end of the semicylindrical wall section 8A is a bottom plate 12 on which a nail package mounting mechanism 13 is centrally located. Additionally, a substantially L-shaped hooking piece 14 is formed integrally with the top end of the semicylindrical wall section 8A and is adapted to engage one edge portion of the cover 9 of the cover wall section 5B when the cover section 5B is closed relative to the fixed section 5A.

As shown in FIG. 1, the nail package mounting mechanism 13 includes a hollow shaft 13*a* vertically extending from the central portion of the bottom plate 12. The shaft 13*a* is formed with a pair of diametrically disposed through holes 13*b* for receiving locking balls 15 therein. Slidably received in the shaft 13*a* is an operating rod 17 which has a locking groove 16 engageable with the locking balls 15 in the holes 13*b*. Additionally, an operating cylinder 19 is provided being slidably disposed around the shaft 13*a* and which is formed with a locking groove 18 engageable with the locking balls 15. The operating cylinder 19 includes a floor plate 20 secured to the lower end thereof for carrying a nail package P. A spring 19*a* is disposed between the operating rod 17 and the operating cylinder 19. Thus, when the operating rod 17 is pushed downwardly from the position shown in FIG. 1, the balls 15 project into the locking groove 16 and thence the operating cylinder 19 is displaced downwardly under the biasing action of the spring 19*a* until the floor plate 20 bottoms down, thereby permitting the insertion of different heights of nail packages into the storing section 6.

Figure 3:
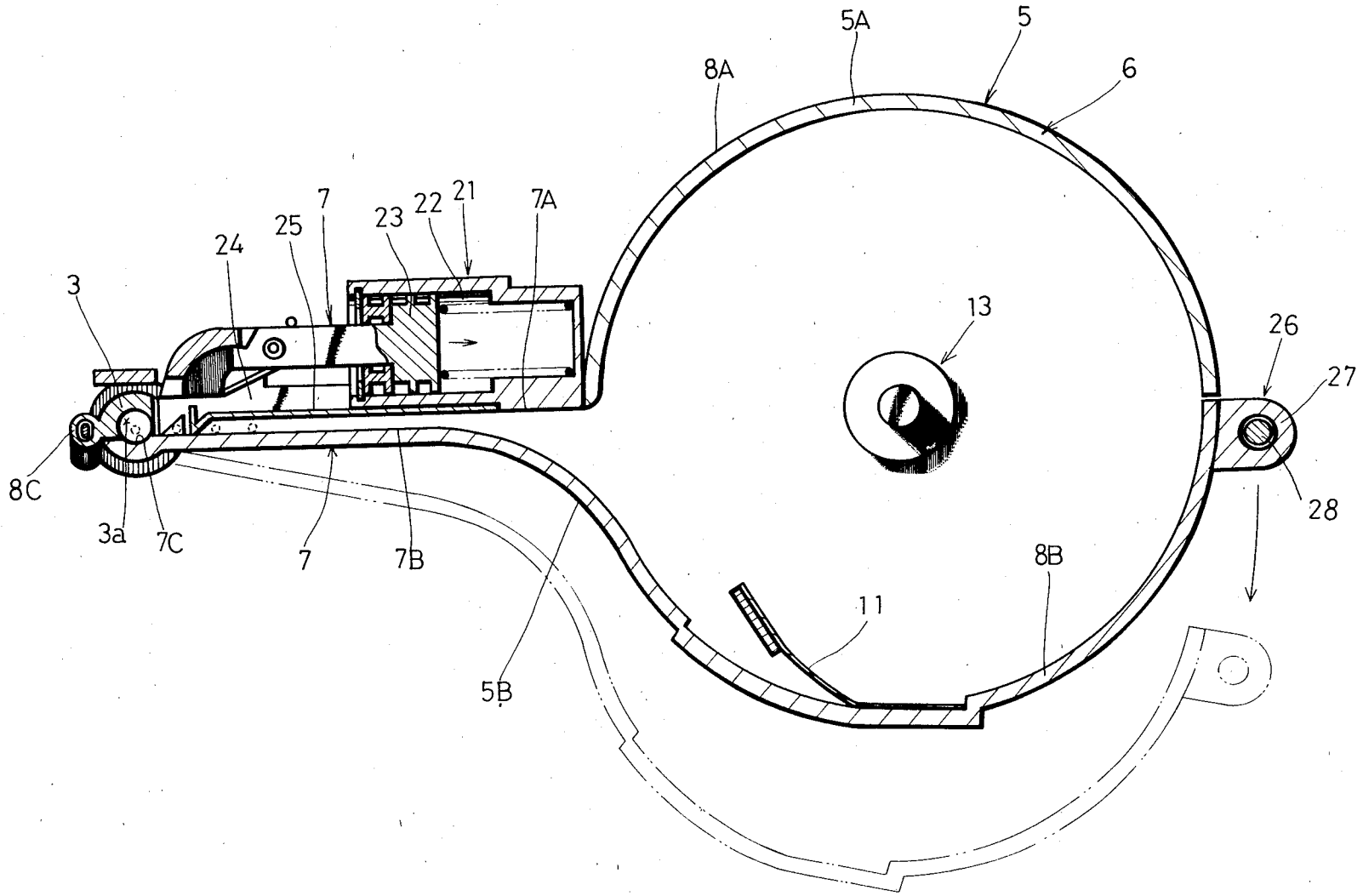
FIG. 3 is a cross-sectional view taken along the line III—III of FIG. 1.
Figure 5:
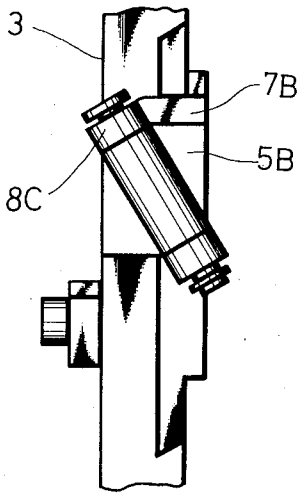
FIG. 5 is a side elevational view of the hinge means.

A nail feeding mechanism 21 is mounted to the forward end of the nail guiding wall section 7A. Specifically, as shown in FIG. 3, the forward end portion of the nail guiding wall section 7A includes secured thereto an actuating chamber 22 which communicates with an air circuit for actuating nail driving means (not shown). A piston 23 is provided being movably received within the chamber 22 in a direction of the arrow and which includes a feed claw 24 operatively connected thereto. Additionally, a check claw 25 is mounted to the nail guiding wall section 7A. Thus, the nails are fed one at a time into the drive track 3*a* of the driver guide 3 each time the piston 23 is reciprocated.

Figure 4:
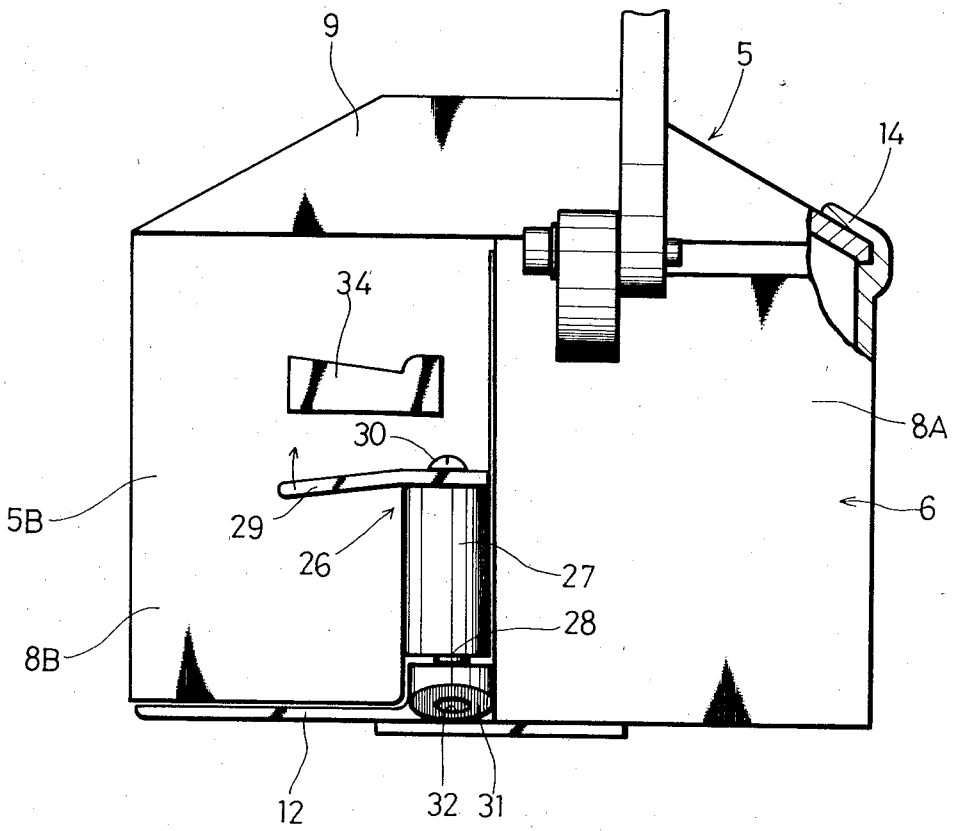
FIG. 4 is a view, partly in cross section, taken in the direction of the arrow Y in FIG. 1.

As best shown in FIG. 4, a suitable locking mechanism 26 is provided for retaining the semicylindrical wall section 8B and hence the pivotally mounted cover section 5B in operative closed position. Specifically, a guide sleeve 27 is secured to the intermediate portion of the rearward end of the wall section 8B and extending axially downwardly thereon. The guide sleeve 27 includes a locking pin 28 slidably received therein and having one end projectable from the lower end thereof. An operating lever 27 is connected at one end to the upper end of the locking pin 28 through a screw 30, the other end extending laterally along the outer periphery of the wall section 8B. A locking lug 31 is formed on the lower end of the semicylindricall wall section 8A of the fixed section 5A and is disposed generally opposite to the lower end of the guide sleeve 27. The locking lug 31 is formed with a locking bore 32 into which the lower end of the locking pin 28 is projectable. The locking pin 28 is normally urged by a spring 33 (FIG. 1) into the locking bore 32, that is, in a direction in which the locking pin 28 projects downwardly of the guide sleeve 27. Additionally, an abutment block 34 is provided on the periphery of the wall section 8B and opposite to the operating lever 29 and is adapted to be gripped together with the operating lever 29 as the latter is pulled up from the guide sleeve 27 to release the locking position of the cover section 5B.

The nail driving tool 1 thus constructed is operated as follows.

Before commensing operation, it is first necessary to mount a nail package P in operative position within the magazine 5. To accomplish this, the operator actuates the operating lever 29 of the locking mechanism 26 to thereby lift the locking pin 28 out of the locking bore 32 of the locking lug 31. The operator then pivots the cover section 5B about the hinge means 8C of the driver guide 3 into open position remote from the handle 4, that is, in a direction away from the operator. In this open position, substantially all of the inside surface of the semicylindrical wall section 8A, the nail guiding wall section 7A, and the drive track 3*a* of the driver guide 3 are fully exposed. The operator loads the nail package P over the nail package mounting mechanism 13 and manually positions the leading portion of the outer coil layer of the nail package P so that the heads NT of the nails therein are engaged within the nail guiding section 7A and the nail guiding channel 7D and the first leading nail is disposed within the drive track 3*a* of the driver guide 3, the subsequent nail being engaged with the feed claw 24.

After this loading procedure has been performed, the movable cover section 5B of the magazine 5 is pivoted into operative closed position, that is, toward the operator, to be mated with the fixed section 5A. The operator actuates the locking lever 29 to bring the locking pin 28 into extended locking position in the locking bore 32 so that the cover section 5B is firmly retained in operative position. At this time, the hooking piece 14 engages a portion of the cover 9 so that the movable cover section 5B is firmly retained on the fixed section 5A.

Now, the nail driving operation can be started. The nail package P is fed from the storing section 6 through the nail guide section 7 into the drive track 3*a* of the driver guide 3 by operation of the nail feed mechanism 21 actuated in timed relation with the drive stroke.

From the foregoing description, it can be appreciated that the insertion of a package P of nails into the magazine 5 may be easily and rapidly effected, there being no obstruction to the operator, since the cover section 5B is pivoted about the driver guide 3. When the cover section 5B is opened, the drive track 3*a* is capable of being exposed and therefore, the guidance of nails into the drive track 3*a* may be easily effected. Further, should a nail jam or hang-up occur in the drive track, the impediment can be rapidly cleared. Also, it can be appreciated that the hooking piece 14 enables the cover section 5B to be positively retained on the fixed section 5A, thereby preventing possible pivotal movement of the cover section 5B into open position due to vibrations or like forces which may be developed during operation.

Figure 7:
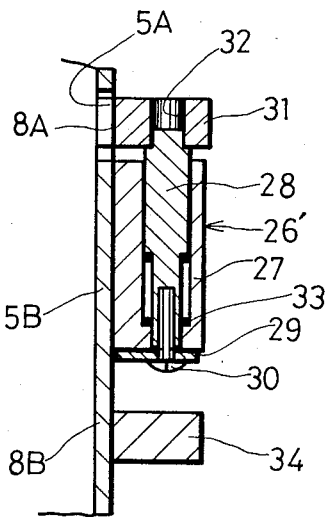
FIG. 7 is a cross-sectional view taken along the line VII—VII of FIG. 6.
Figure 6:
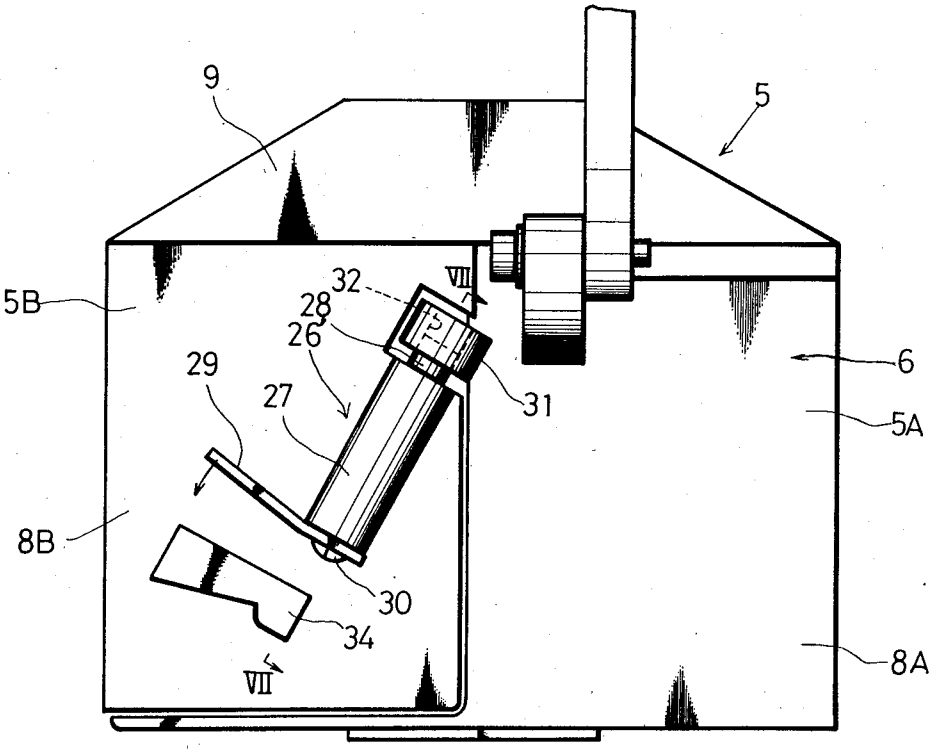
FIG. 6 is a side elevational view of a modified arrangement of the locking mechanism.

FIGS. 6 and 7 show an alternative locking mechanism 26′ which may be used in place of the locking mechanism 26 shown in FIGS. 1 and 4.

In the modified arrangement shown in FIGS. 6 and 7, an angularly disposed locking mechanism 26′ is provided corresponding to the locking mechanism 26 of the foregoing embodiment but being arranged in substantially inverted configuration of the foregoing locking mechanism 26, the locking lug 31 being disposed generally on the upper portion of the semicylindrical wall section 8A of the fixed section 5A. In other respects, the arrangement is substantially the same as that of the foregoing embodiment. All parts are numbered to correspond to similar parts of FIG. 1, and the general description of the parts of FIG. 1 is applicable to the corresponding parts of FIGS. 6 and 7. Thus, in this modified arrangement, the angularly disposed locking mechanism 26′ enables the cover section 5B to be locked more positively than in the embodiment described above, thereby eliminating the need for hooking piece 14 of the fixed section 5A.

While the invention has been described with reference to preferred embodiments thereof, it is to be understood that modifications or variations may be easily made without departing from the spirit of this invention which is defined by the appended claims.

What is claimed is:

1. A tool for driving nails into a workpiece comprising:

a housing including a reciprocable driver;

a driver guide fixedly connected to and extending vertically from the lower end of said housing for slidably receiving said driver therein and including a driver track portion;

a handle secured to and extending laterally outwardly from the central portion of said housing; and a magazine including a storing portion adapted to receive a nail package including a multiplicity of nails interconnected in series and a nail guiding portion adapted to guide the leading portion of the nail package to said driver guide, said magazine including a fixed wall portion secured at one end to said driver guide and extending generally below and parallel with the longitudinal extent of said handle and a closure wall portion including integral nail guiding and nail storing components defining at least a part of the driver track of the driver guide pivotally movable about said driver guide with respect to said fixed wall portion between an operative closed position and an open position exposing the interior of said magazine, and locking means for retaining said closure wall portion on said fixed wall portion when said closure wall portion is in its operative closed position.

2. The tool as defined in claim 1 wherein said storing portion of said magazine is substantially cylindrical in shape including a peripheral wall portion, and wherein said nail guiding portion of said magazine defines a feedway for communicating said storing portion with said driver guide and includes a wall portion substantially continuous to the peripheral wall portion of said storing portion.

3. The tool as defined in claim 1 wherein said storing portion of said magazine is fixedly connected to said handle through a downwardly depending, handle butt portion formed on the rearward end of said handle.

4. The tool as defined in claim 1 wherein said closure wall portion of said magazine defines a drive track for guiding said driver substantially in cooperation with said driver guide.

5. The tool as defined in claim 1 further comprising a vertically extending guide sleeve secured to the rearward end of said closure wall portion of said magazine, a hollow locking lug formed on the rearward end of said fixed wall portion of said magazine and extending laterally below the lower end of said guide sleeve, a locking pin slidably received in said guide sleeve and biased by a spring to project into and retract from said hollow locking lug, and an operating lever disposed generally above said guide sleeve and operatively connected to the top portion of said locking pin, whereby said operating lever is operative to urge said locking pin into said hollow locking lug to thereby retain said closure wall portion on said fixed wall portion.

6. The tool as defined in claim 1 further comprising a hollow locking lug formed generally on the upper rearward end of said fixed wall portion of said magazine, a guide sleeve secured to the rearward end of said closure wall portion of said magazine and extending directly below said hollow locking lug, a locking pin slidably received in said guide sleeve and biased by a spring to project into and retract from said hollow locking lug, and an operating lever disposed generally below said guide sleeve and operatively connected to the lower end portion of said locking pin, whereby said operating lever is operative to urge said locking pin into said hollow locking lug to thereby retain said closure wall portion on said fixed wall portion.

7. The tool as defined in claim 1 wherein said closure wall portion of said magazine is of transparent molded plastic material.

* * * * *